US005818337A

United States Patent [19]

Erismann

[11] Patent Number: 5,818,337

[45] Date of Patent: Oct. 6, 1998

[54] MASKED PASSIVE INFRARED INTRUSION DETECTION DEVICE AND METHOD OF OPERATION THEREFORE

[75] Inventor: Fernando Erismann, Elk Grove, Calif.

[73] Assignee: C & K Systems, Inc., Folsom, Calif.

[21] Appl. No.: 782,397

[22] Filed: Jan. 13, 1997

[51] Int. Cl.[6] ..... G08B 13/191; G08B 13/193

[52] U.S. Cl. ..... 340/567; 250/340; 250/342; 250/395

[58] Field of Search ..... 340/567; 250/340, 250/342, 395, 349, 353

[56] References Cited

U.S. PATENT DOCUMENTS 4,841,284 6/1989 Biersdorff ..... 340/567

*Primary Examiner*—Glen Swann

*Attorney, Agent, or Firm*—Pearson & Pearson

[57] ABSTRACT

A passive infrared intrusion detection device uses a dual element pyroelectric detector and a housing for surrounding and containing the dual element pyroelectric detector. The housing has a plurality of Fresnel lens elements for gathering infrared radiation from a "look down" volume of space and for focusing the gathered infrared radiation onto the pyroelectric detector. A mask positioned between the plurality of Fresnel lens elements and the detector partially occludes the gathered infrared radiation from the Fresnel lens elements to one of the elements of the dual element pyroelectric detector creating an imbalance in the signal thereby preventing common mode rejection.

13 Claims, 3 Drawing Sheets

MASKED PASSIVE INFRARED INTRUSION DETECTION DEVICE AND METHOD OF OPERATION THEREFORE

TECHNICAL FIELD

The present invention relates to a passive infrared intrusion detection device using a Fresnel lens, a dual element pyroelectric detector, and a masking element for detecting intruders in a near volume of space.

BACKGROUND OF THE INVENTION

Passive infrared intrusion detection devices are well known in the art. Typically, they comprise a dual element pyroelectric detector. The dual elements are connected electrically in series. An intruder is detected when a positive signal is produced from one of the elements followed by a negative signal from the second element. The dual element pyroelectric detector is more reliable than a single element detector. A Fresnel lens, typically located in the housing which surrounds the dual element pyroelectric detector, focuses the infrared radiation onto the dual elements. Typically, the housing is made of plastic and the Fresnel lens is also molded out of plastic. The passive infrared detection device is then mounted, typically along a wall, spaced from the floor or ground, to detect intruders in a volume of space. In addition, the passive infrared intrusion detection device can be a stand alone device or it can be a part of a multisensor detection device such as used with a microwave detection device.

One of the shortcomings of a passive infrared intrusion detection device is that a would-be intruder can avoid detection by moving along the wall where the detection device is mounted. In an effort to thwart such type of undetected intrusion, so-called "look down" detectors have been employed. These look down detectors comprising, a segmented mirror or a plurality of lenses, are added to the dual element detectors and are directed to gather and focus infrared radiation generated from the volume of space directly beneath or near the detection device. See, for example, U.S. Pat. No. 4,841,284. The look down mirror or lenses is positioned adjacent to the detector and is directed to gather and focus infrared radiation from the "close-up" region near the detection device.

All of these "look-down" devices suffer from the shortcoming that the lens or the mirror gather infrared radiation which must pass through the housing which contains the detection element. These cause many limitations, among which are the field of view must depend upon the size and placement of the transparent window through which the infrared radiation must pass. Small or low profile sensors will severely restrict the field of view of the look down system. In addition, because the light must pass through a transparent window (transparent to the infrared radiation) before reaching the optical element, the window attenuates the light due to reflection and absorption. Further, the look down lens or mirror must be placed so that it does not interfere with the optics that gather infrared radiation in the forward region of the detection device, the volume of space to which the detection device is designed to operate. Thus, because of this limitation, the lens or the mirror must be small and must be placed at an oblique angle to the face of the detector. Since the responsiveness of most pyroelectric detectors is related to the cosine of the angle of incidence, the oblique angle to which the lens or the mirror must be placed reduces the effectiveness of the detector.

SUMMARY OF THE INVENTION

A passive infrared intrusion detection device has a dual element pyroelectric detector. A housing surrounds and contains the dual element pyroelectric detector. The housing has a plurality of Fresnel elements for gathering infrared radiation from a volume of space and for focusing the gathered infrared radiation onto the pyroelectric detector. A mask is positioned between the plurality of Fresnel lens elements and the detector for partially occluding the gathered infrared radiation from the Fresnel lens elements to one of the elements of the dual element pyroelectric detector.

DETAILED DESCRIPTION OF THE INVENTION

Figure 1:
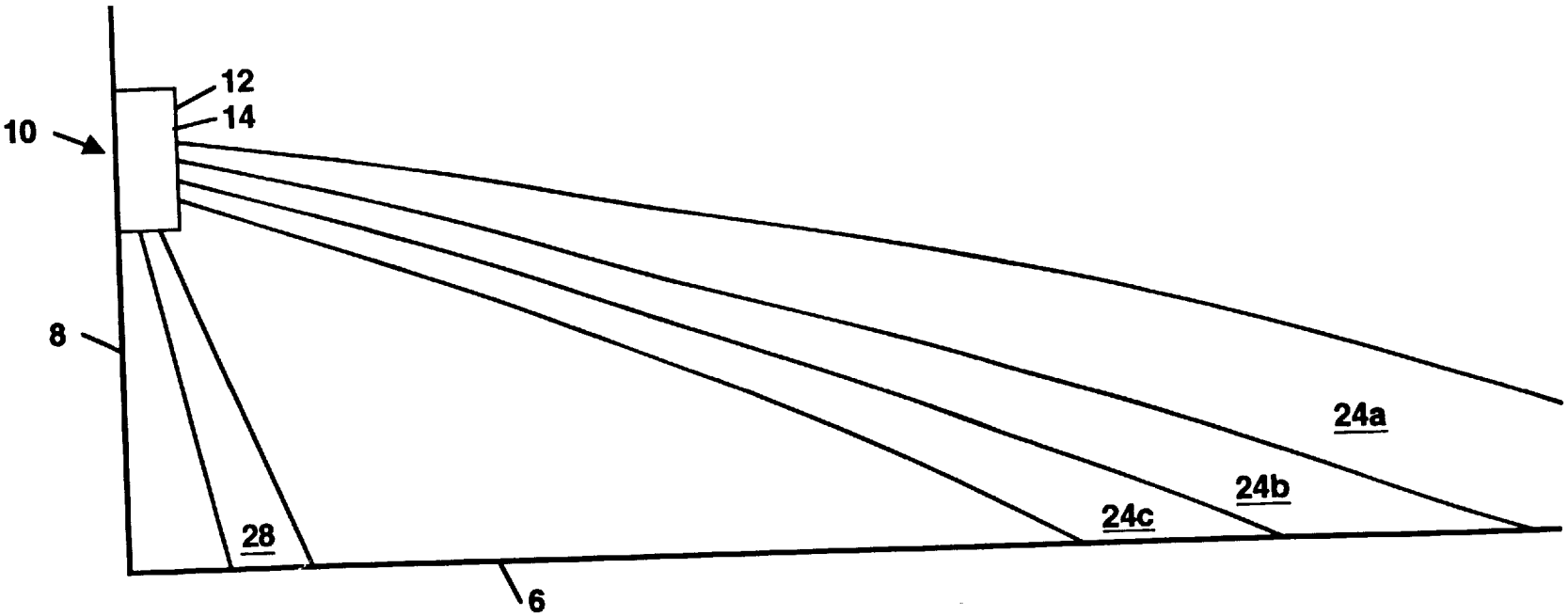
FIG. 1 is a side schematic view of an improved passive infrared intrusion detection device of the present invention along with the volumes of space including the close-up volume, to which the detection device is directed to detect intruders.

Referring to FIG. 1 there is shown a schematic side view of a passive infrared intrusion detection device 10 of the present invention. The device 10 comprises a housing 12 which surrounds and contains a dual element pyroelectric detector 20. The housing 12 has a plurality of first Fresnel lenses 22(A–C) or lens elements 22(A–C) located long the front surface 14 thereof. The first Fresnel lens 22(A–C) gathers and focuses infrared radiation from volumes of space 24(A–C) and for focusing the gathered infrared radiation onto the pyroelectric detector 20.

The housing 12 also comprises a second plurality of Fresnel lenses 26(A–B), positioned and located along a lower surface 16 of the housing 12. The second plurality of Fresnel lens element 26(A–B) are directed to gather infrared radiation from the volumes of space 28 that are "near" the detection device 10. Typically, the device 10 is mounted along a wall 8, spaced apart from a floor or ground 6. The "near" volumes of space 28 are near the wall 8.

The frontal surface 14 and the lower surface 16 of the housing 12 are substantially perpendicular to one another. The housing 12 can be made out of plastic with the first plurality of Fresnel lens elements 22(A–C) and the second plurality of Fresnel lens elements 26(A–B) molded therein, and made of high density polyethylene. High density polyethylene is substantially transparent to infrared radiation. Alternatively, the first plurality of Fresnel lens elements 22(A–C) and the second plurality of Fresnel lens elements 26(A–B) can be molded out of a separate plastic with the lens elements then mechanically attached (through a clip, or snap or some other means) onto a housing 12, which need not be made out of plastic.

Figure 2:
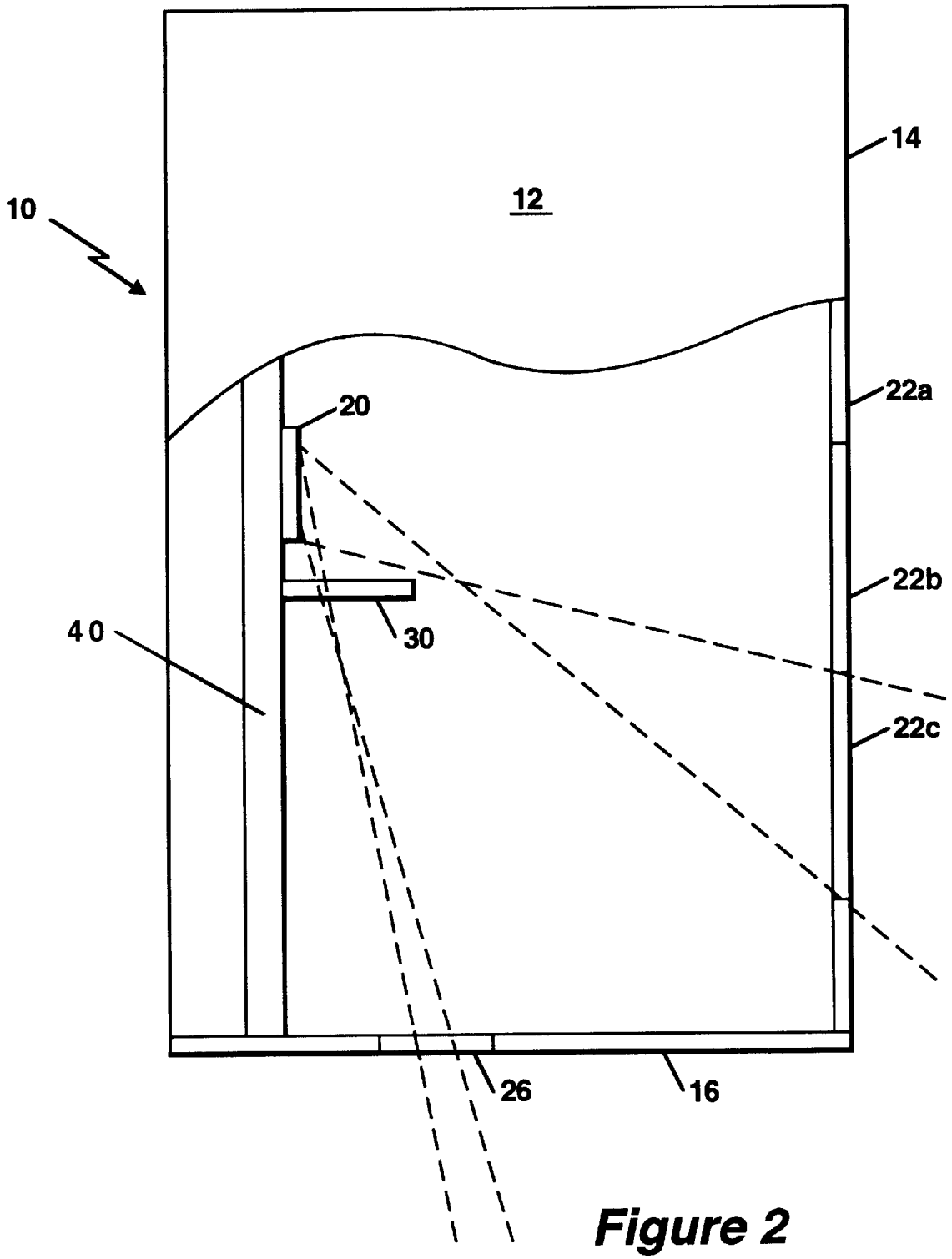
FIG. 2 is a partial cut-away side view of the passive infrared intrusion detection device of the present invention showing the dual element pyroelectric detector, a mask, and a portion of the housing containing the Fresnel lens for gathering and focusing infrared radiation.

Referring to FIG. 2 there is shown a partial cut-away view of the detection device 10 of the present invention. As can be seen in FIG. 2, the infrared radiation gathered by the first plurality of Fresnel lens elements 22(A–C) are focused unobstructed onto the dual element pyroelectric detector 20.

As is well known in the art, each Fresnel lens element, e.g., 22*a*, is directed to detect infrared radiation from its corresponding volume of space, e.g., 24*a*. Thus, although three volumes of space is shown in FIG. 1 and three sets of Fresnel lens elements 22(A–C) are shown in FIG. 2, the number is not so limited.

Figure 3:
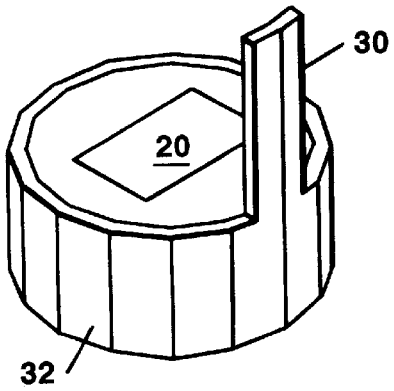
FIG. 3 is a perspective view of a dual element pyroelectric detector along with its mask.

The infrared radiation gathered by the second plurality Fresnel lens elements 26(A–B) from the volume of space 28, are gathered and focused and directed to the dual element pyroelectric detector 20, but having been partially occluded by a masking element 30. The masking element 30 serves to block or mask part of the infrared radiation from a volume of space 28 gathered by a corresponding Fresnel lens 26. Referring to FIG. 3, there is shown a perspective view of masking element 30 and the dual element pyroelectric detector 20. The dual element pyroelectric detector 20 is housed in a plastic housing 32 mounted on a printed circuit board 40. The masking element 30 can be a tab or a projection of the housing 32 which contains the pyroelectric detector 20. The masking element 30 extends into the line of sight between the detector 20 and the second plurality of Fresnel lens 26, but does not extend into the line of sight between the dual element pyroelectric detector 20 and the first plurality of lens elements 22(A–C). Typically, the mask 30 has a width of one to two millimeters and extends from 2–7 millimeters above the planar surface of the pyroelectric detector.

THEORY

If one were to simply substitute the look down mirror or look down lens of the prior art with an off axis Fresnel lens or a plurality thereof molded directly into the housing 12, the requirement that the housing 12 not restrict the field of view of the first plurality of Fresnel lens elements 22(A–C) would cause the focal length of the second plurality of Fresnel lens elements (26)(A–B) to be 20 millimeters or longer. In addition, the second Fresnel lens elements 26, must be far located from the detector 20.

Under such conditions, and further because the pyroelectric detector 20 is a dual element type, a phenomena known as common mode rejection can occur. As previously discussed, with a dual element pyroelectric detector 20, a positive and negative edges of a detection zone are produced. Common mode rejection occurs when the intruder occupies both the positive and the negative edges of the detection zone. If each element of the detector has equal responsiveness, the net signal will be zero resulting in no detection of the intruder. However, in reality, there is some imbalance between the elements of the dual element pyroelectric detector 20 and the position of the target so that the signal is weak and unreliable.

In a typical setting, the passive infrared intrusion detector device 10 is located approximately six (6) to ten (10) feet from the ground 6. The zone of detection would then be 5 inches wide. With this dimension, common mode rejection would be unavoidable. The angular width or spread of a zone is determined approximately as follows:

$$\theta := atan\left(\frac{2 \cdot W_e + W_g}{f}\right)$$

$W_e$ = pyro element width (typically 1 mm)

$W_g$ = width of gap between elements (typically 1 mm)

$f$ = focal distance (varies, typically 20 mm to 60 mm)

Figure 4:
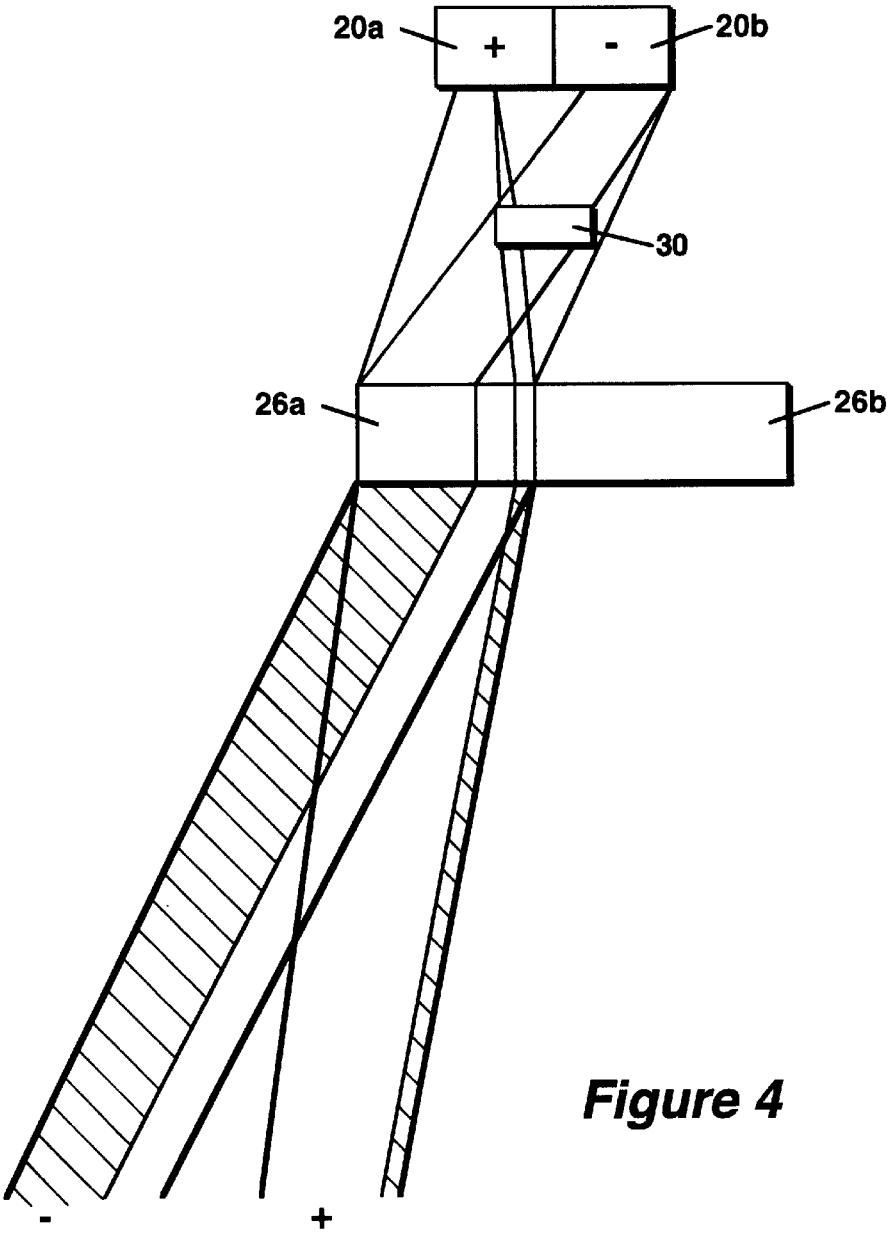
FIG. 4 is a schematic front view of the dual element pyroelectric detector, a mask, the Fresnel lens, and the occlusion effect of the mask in the near volume of space to which the detector is directed to detect.

Referring to FIG. 4 there is shown schematically the dual element pyroelectric detector 20, the masking element 30, and a second plurality Fresnel lens element 26(A–B). Each lens element, e.g., 26A, produces a pair of detection edges with opposite polarity. This is designated as "+" and "−", corresponding to the dual elements 20A and 20B, respectively. At close range, these edges "+" and "−" will be very narrow and an intruder will be able to occupy both edges at the same time, creating a common mode rejection problem and a weak signal. However, when the masking element 30 is added, each pyroelectric element, e.g., 20A or 20B, is shaded from viewing the lens element on the opposite side by a different amount. When an intruder enters into the detection pattern, the intruder will be visible to a larger extent by one of the single detector element, e.g., "+" element or "−" element 20A. With this arrangement, there will be little or no common mode rejection, and the signal amplitude will be very strong. It should be emphasized that it is not needed to completely mask one of the elements. What is required is only to partially mask one of the elements so that the resultant signal from the dual element detector 20A and 20B will be imbalance in their sensitivity, producing a strong signal.

What is claimed is:

1. A passive infrared intrusion detection device for detecting infrared radiation from a volume of space, said device comprising:

a dual element pyroelectric detector;

a housing for surrounding and containing said dual element pyroelectric detector; said housing having a plurality of fresnel lens elements for gathering infrared radiation from said volume of space and for focusing said gathered infrared radiation onto said pyroelectric detector; and a mask positioned between said plurality of fresnel lens element and said detector for partially occluding said gathered infrared radiation from said fresnel lens elements to one of said elements of said dual elements pyroelectric detector.

2. The device of claim 1 wherein said housing is made of plastic with said plurality of fresnel lens elements molded therein.

3. The device of claim 1 wherein said plurality of fresnel lens elements are made of high density polyethylene.

4. A passive infrared intrusion detection device for detecting infrared radiation from a first and a second volume of space, said device comprising:

a dual element pyroelectric detector;

a housing for surrounding and containing said dual element pyroelectric detector; said housing having a first plurality of fresnel lens elements for gathering infrared radiation from said first volume of space and for focusing said gathered infrared radiation onto said pyroelectric detector; said housing further having a second plurality of fresnel lens elements for gathering infrared radiation from said second volume of space and for focusing said gathered infrared radiation onto said pyroelectric detector; and a mask positioned between said second plurality of fresnel lens elements and said pyroelectric detector for partially occluding said gathered infrared radiation from said second plurality of fresnel lens elements to one of said elements of said dual element pyroelectric detector.

5. The device of claim 4 wherein said housing is made of plastic with said first and second plurality of fresnel lens elements molded therein.

6. The device of claim 4 wherein said plurality of fresnel lens elements are made of high density polyethylene.

7. The device of claim 4 wherein said first plurality of fresnel lens elements is in said housing in a first plane, said second plurality of fresnel lens elements is in said housing in a second plane, substantially perpendicular to said first plane.

8. The device of claim 7 wherein said second volume of space is closer to said housing than said first volume of space.

9. The device of claim 7 wherein said housing is made of plastic with said first and second plurality of fresnel lens elements molded therein.

10. The device of claim 4 wherein each of said second plurality of fresnel lens elements has a focal length greater than about 20 mm.

11. A method of detecting an intruder in a volume of space, said intruder radiating infrared radiation; said method comprising:

gathering said infrared radiation from said volume of space by a plurality of optical elements and focusing said gathered infrared radiation onto a dual element pyroelectric detector; and partially occluding said gathered infrared radiation from said optical elements to one of said elements of said dual element pyroelectric detector.

12. The method of claim 11 wherein said optical elements are fresnel lens elements.

13. The method of claim 12 wherein said plurality of fresnel lens elements comprising two fresnel lens elements.

* * * * *